United States Patent [19]

Backman

[11] Patent Number: 4,740,315

[45] Date of Patent: Apr. 26, 1988

[54] FILTER SYSTEM FOR WIRE ELECTRONIC DISCHARGE MACHINING

[76] Inventor: Sune Backman, Yngyevagen 6, Djursholm: 5-182 64, Sweden

[21] Appl. No.: 901,709

[22] Filed: Aug. 28, 1986

Related U.S. Application Data

[63] Continuation-in-part of Ser. No. 646,726, Sep. 4, 1984, Pat. No. 4,710,402.

[51] Int. Cl.[4] ..... B01D 25/02

[52] U.S. Cl. ..... 210/771; 210/798

[58] Field of Search ..... 210/770, 771, 798

[56] References Cited

U.S. PATENT DOCUMENTS

| | | | |
|---|---|---|---|
| 2,568,144 | 9/1951 | Cremer et al. | 154/101 |
| 2,654,440 | 10/1953 | Robinson | 183/44 |
| 2,773,602 | 12/1956 | Sylvester | 210/166 |
| 3,294,582 | 12/1966 | Suchy | 117/155 |
| 4,092,247 | 5/1978 | Madsen | 210/770 |
| 4,161,422 | 7/1979 | Lawson et al. | 162/135 |
| 4,358,383 | 11/1982 | Asp | 210/771 |
| 4,472,229 | 9/1984 | Martin | 156/307.1 |
| 4,664,814 | 5/1987 | Backman et al. | 210/780 |

FOREIGN PATENT DOCUMENTS

| | | |
|---|---|---|
| 17985 | 2/1976 | Japan . |
| 226274 | 12/1924 | United Kingdom . |

OTHER PUBLICATIONS

Myron L. Begeman and B. H. Amstead, *Manufacturing Processes*, 1963, John Wiley & Sons, Inc., New York, 5th Edition, pp. 410–411.

*Primary Examiner*—Frank Sever

*Attorney, Agent, or Firm*—Seidel, Gonda, Goldhammer & Abbott

[57] ABSTRACT

The present invention is directed to a method of removing metallic hydroxide salts having impurities from an aqueous medium. The method includes the steps of:

(a) providing an edge type filter;

(b) passing an aqueous medium with metallic hydroxide salts having impurities to the filter;

(c) removing the metallic hydroxide salts with the filter and forming a cleaned aqueous medium;

(d) removing the cleaned aqueous medium from the filter;

(e) drying the filter after the filter has become blocked by the metallic hydroxide salts and forming a powder; and (f) removing the powder from the filter, whereby the filter is unblocked.

11 Claims, 1 Drawing Sheet

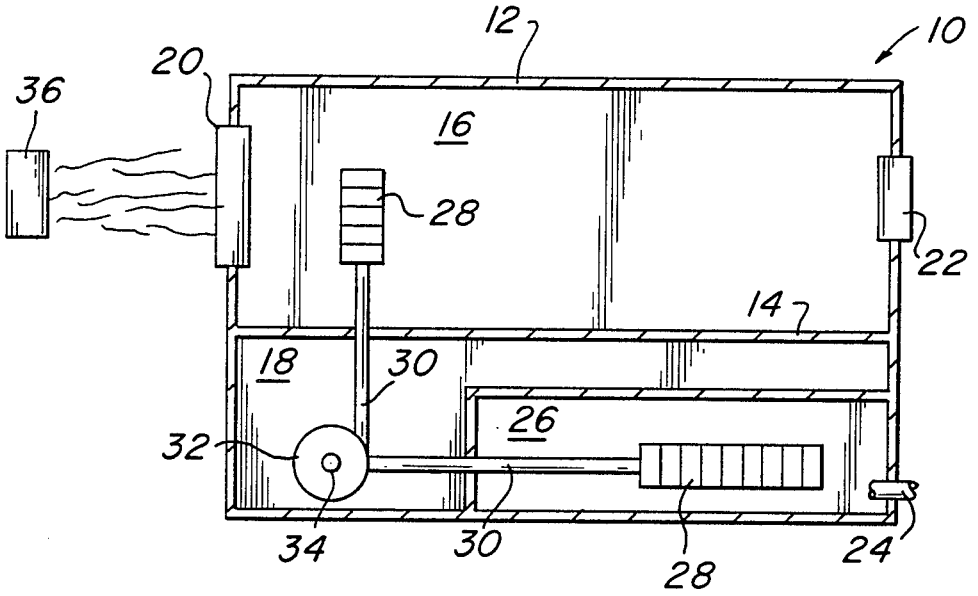
12
10
20
36
16
28
22
14
18
30
26
32
34
30
28
24

FILTER SYSTEM FOR WIRE ELECTRONIC DISCHARGE MACHINING

This is a continuation-in-part of copending U.S. Patent application Ser. No. 646,726 entitled "Filter Paper and Method for Making Filter Paper" and filed on Sept. 4, 1984 by S. Backman and H. Hakanson, now U.S. Pat. No. 4,710,402. The claimed subject matter of this continuation-in-part was invented by S. Backman.

SCOPE OF THE INVENTION

The present invention is directed to an edge type filter system for use in processes which generate metallic hydroxides, such as a wire electronic discharge machining (wire EDM) process.

BACKGROUND OF THE INVENTION

An edge filter (see generally U.S. Pat. No. 2,773,602) utilizes a plurality of concentric flat annular discs stacked one upon another and supported by a tube which engages the inner annular ring of the disc. Between the discs is a small space or interstice. The internal tube is porous such that a fluid may permeate through the wall into the inner cavity of the tube. The edge filter operates by introducing the liquid material to be filtered to the area outside of the stack of annular discs. The liquid is then forced between the interstices of the stacked discs where particles are mechanically blocked in the interstices. Additionally, particles which would normally pass through the interstices may be captured on the plane surfaces of the discs. The filtered liquid may then penetrate the internal tube and be removed from the filter device through the cavity in the tube.

The performance of a filter is determined by the filter's ability to remove particles from the liquid and the flow rate of material through the filter.

Particle removal ability can be further viewed as (a) the filter's ability to remove all suspended solids from the liquid, and (b) the filter's ability to remove suspended solids of a particular particle size. Of special concern in the area of edge filter, is the filter's ability to remove suspended solids of a size which would normally pass through the interstice. To accomplish the capture of those solid particles which would pass through the interstice, a disc with a coarse surface may be used.

The flow rate through the filter device depends upon the pressure drop across the filter. Across the filter meaning from outside of the annular discs to the inside cavity of the tube. Increased pressure drop due to fouling of the interstices and swelling of the paper, causes reduced flow through the filter. Three primary causes of increased pressure are (a) fouling of the interstices with filtered particles, (b) swelling of the filter paper due to absorption of the filtered liquid into the paper, and (c) reduction of the size of the interstices due to compression of the annular discs by the compressive forces from the surrounding liquid. Thus, to maintain the flow through the filter it is imperative to minimize the increase in pressure drop across the filter caused by swelling and compression of the interstices.

Filter discs used in prior art edge filters, as described above, are made of metal, plastic, paper or fibrous material. Metal or plastic edge filters are able to withstand the compressive force exerted by the surrounding liquid thus reducing increased pressure drop due to compression of the discs. But the surfaces of the metal discs are smooth, thus unable to capture particles too small to be blocked by the interstices. Thus, effectiveness of removability is reduced because no coarse surface is provided to catch small particles.

Edge filters made of paper or fibrous material are able to entrap particles too small to be blocked in the interstices. This is due to the coarse surfaces on the plane portions of the discs. But paper or fibrous material is unable to withstand the compressive force of the liquid. The compression due to the surrounding liquid will cause the interstices to close.

Paper and fibrous materials have the ability to absorb the liquid. Absorption of the liquid causes fibers to swell. The swelling adversely affects filter operation by causing the interstices to close and reducing the ability to entrap small particles on the plane surfaces of discs.

The wire EDM process utilizes water as a dielectric medium. A fine EDM erosion product is removed by the water. The EDM process causes metallic hydroxide salts to be formed. A filtering system for removal of the fine EDM erosion product and the metallic hydroxide salts is needed.

SUMMARY OF THE INVENTION

The present invention is directed to a method of removing metallic hydroxide salts having impurities from an aqueous medium. The method includes the steps of:

(a) providing an edge type filter;

(b) passing an aqueous medium with metallic hydroxide salts having impurities to said filter;

(c) removing said metallic hydroxide salts with said filter and forming a cleaned aqueous medium;

(d) removing said cleaned aqueous medium from said filter;

(e) drying said filter after said filter has become blocked by said metallic hydroxide salts and forming a powder; and (f) removing said powder from said filter, whereby said filter is unblocked.

A filter paper which is impregnated with a phenolic resin is utilized in the above described method. The impregnated filter paper has enhanced qualities. The resin totally encapsulates the individual paper fibers thus creating an impervious layer, consequently reducing swelling due to absorption of the liquid by the paper. Yet, the coarseness of the plane surfaces of the disc remain intact, thus allowing capture of small particles. Additionally, the resin binds the paper in a rigid form thus giving the paper additional mechanical strength to resist radial compression due to the pressure of the surrounding liquids. The result is a filter material which has a longer useable life due to the reduction of the swelling of the filter paper and resistance to compression of the filter paper.

A further advantage of the impregnated paper filter material is that the randomly arranged fibers of the paper create an irregular surface pattern able to entrap or catch small particles. Materials with smooth surfaces, such as plastic or metal, do not have the same ability to entrap small particles; because plastic or metal do not have the same irregular surface that the impregnated paper filters have.

DESCRIPTION OF THE DRAWING

For the purpose of illustrating the invention, there is shown in the drawings a form which is presently preferred; it being understood, however, that this invention is not limited to the precise arrangements and instrumentalities shown.

The FIGURE is a schematic illustration of an embodiment of the present invention.

DESCRIPTION OF THE INVENTION

The filter paper is in the shape of an flat annular disc. The individual discs may be stacked on top of one another with an interstice between them. The stacked discs are engaged at their inner annular ring by a porous tube. The irregular plane surface of the individual discs, which is created by the randomly orientated paper fibers, creates additional surface area so to catch small particles which would not be blocked by the interstice space between the individual discs. A compressive force may be exerted axially upon the discs so to regulate or control the interstitial space between the individual discs.

The method for making the discs begins with a sheet of commercially available 82 gram filter paper. This paper is soaked in a phenolic resin, such as formalin. Alternately, the discs can be made of a 70 gram filter paper which has been impregnated with a phenolic resin known in the trade as "Fenolharts", a tradename for a phenolic resin manufactured by AB CASCO of Sweden. The paper is soaked until the phenolic resin has saturated the paper.

The paper sheet is then punched to form the flat annular filter discs. The discs must be punched from the sheet prior to setting the phenolic resin. This sequence must be followed because once the phenolic resin has hardened upon the paper, the paper becomes too brittle for the stamping process.

The phenolic soaked discs are then heated so as to fuse or cure the resin in close contact with the paper fibers. The optimum temperature at which this heating should occur is about 130° C. The heating, at the prescribed temperature, should last for approximately 2 hours and 10 minutes. While the heating of the discs occurs, it is best to compress the discs just above atmospheric pressure. Alternately, the pressure for compressing the discs can be between about 4 to about 7 psi.

When hardening of the resin occurs or immediately prior to hardening, the discs may have a tendency to stick together. Therefore, the pressure should be reduced and the discs separated or "decoupled" in some manner, such as with the aid of an air stream. This prevents the discs from adhering or sticking together. Additionally, this "conditions" the surface for filtering.

The discs should then be placed on a planed or plane ground smooth plate which is preheated to a temperature of about 100° C. The reason for the raised plate temperature is that the discs would otherwise break upon being rolled. Once on this smooth plate, the discs are rolled by a smooth roller at a pressure of about 250 kg per square centimeter. The object of the rolling is to keep the discs flat and the two faces parallel. The plate may be equipped with a feeding device making it possible to automate the manufacture of the discs.

When making filter paper for use with fluids under high pressure the operating parameters of the process must be altered. The temperature at which fusing of the resin occurs should be between about 150° to about 200° C. The time and pressure aspects of the heating step remain the same. The disc separation at hardening remains the same also. The rolling pressure should be elevated to between about 750 and about 1000 kg per square centimeter, but the plate temperature of about 100° centigrade should remain the same.

Referring to FIG. 1 wherein like numerals indicate like elements, there is shown a schematic illustration of the present invention generally denoted 10.

Filter system 10 comprises a housing 12. Housing 12 is compartmentalized by a separation wall 14 and includes a drying section 16 and a filter section 18.

Drying section 16 includes an inlet 20 and an outlet 22. Inlet 20 is for receiving and passing heated air into drying section 16 from heating source 36.

Within filter section 18, there is a filter chamber 26. An effluent inlet 24 communicates with chamber 26 from the electronic discharge machine process (not shown).

Preferably, two filter cartridges 28 are placed within housing 12. Filter cartridges 28 comprise a stack of filter discs preferably as set forth above. The cartridges 28 are alternately placed within filter chamber 26 and drying section 16. Accordingly, one cartridge 28 is in drying section 16, while the other cartridge 28 is in the filter chamber 26. In this mode of operation, the filter system 10 can be continuously operated.

Filter cartridges 28 are mounted on a conduit 30. The end of conduit 30 which contacts filter cartridge 28 is adapted to allow the passage of clean effluent from the cartridge. Each conduits 30 from each filter cartridges 28 is joined together at a coupler 32. Coupler 32 includes a discharge 34 for the clean effluent from filter cartridges 28. Coupler 32 joins the two conduits 30 in such a manner that the cartridges 28 can be placed within or without the filter chamber 26. Coupler 32 is well known in the art.

The cartridge 28 within drying section 16 is disposed therein in such a manner that heated air from source 36 may pass over and dry it.

In the electronic discharge machining process, a high electrical discharge occurs in the water dielectric. This discharge creates conditions in which metallic hydroxide salts are formed in the water. These salts entrap the fine EDM erosion products. These metallic hydroxide salts with entrapped EDM erosion products are passed to the filter cartridge 28 noted above. The salts are trapped at the edges and surface of the filter discs. The salts form a paste-like coating which cannot be removed by backflushing or a reverse pressure ejection process with an aqueous medium. Such processes are commonly known and practiced in the art as the methods of cleaning edge type filters. Accordingly, the use of edge type filters for the removal of metallic hydroxide salts is extremely difficult due to the inability to clean the edge filter by using standard cleaning techniques.

It has been found that the paste-like coating of metal hydroxide salts on the filter discs can be completely dried when placed in a stream of warm air. When dried, the paste-like metallic hydroxide salts form a cake of very fine powder. This fine powder can be easily removed from the filter surface by blowing air in a reverse manner through the filter cartridge.

It is found that the present system can remove metal particles having a size greater than 1 micron and in fact can remove particles having a sub-micron particle size.

The amount of time required to dry a filter cartridge encrusted with paste-like metal hydroxide salts is less than the amount of time necessary to encrust or block the filter cartridge. Accordingly, a two filter cartridge filtering system is proposed. In this system, one cartridge is always being dried and cleaned and a second cartridge is always being operated as a filter. Accordingly, the system can provide continuous operation because one filter cartridge always remains in service.

The present invention may be embodied in other specific forms without departing from the spirit or essential attributes thereof and, accordingly, reference should be made to the appended claims, rather than to the foregoing specification, as indicating the scope of the invention.

I claim:

1. A method comprising removing a paste-like coating of metallic hydroxide salts having impurities from an aqueous medium generated in an electronic discharge process from a filter, by, (a) providing an edge type filter;

(b) passing an aqueous medium with metallic hydroxide salts having impurities to said filter;

(c) removing said metallic hydroxide salts with said filter and forming a cleaned aqueous medium;

(d) removing said cleaned aqueous medium from said filter;

(e) drying said filter after said filter has become blocked by said metallic hydroxide salts and thereby forming a powder; and (f) removing said powder from said filter, whereby said filter is unblocked.

2. The method according to claim 1 wherein drying said filter comprises blowing air across said filter.

3. The method according to claim 2 further comprising the step of heating said air prior to blowing said air across said filter.

4. The method according to claim 1 wherein removing said powder comprises blowing air through said filter.

5. The method according to claim 4 wherein removing said powder comprises back flushing air through said filter.

6. The method according to claim 1 further comprising the step of removing said filter from said aqueous medium with metallic hydroxide salts before drying.

7. A method comprising removing a paste-like coating of metallic hydroxide salts having impurities from an aqueous medium generated in an electronic discharge process from a filter, by, (a) providing an edge type filter, said filter comprising at least two cartridges, each said cartridge being movable between a drying section and a filtering section, one said cartridge being in said drying section while said other cartridge being in said filtering section;

(b) passing an aqueous medium with metallic hydroxide salts having impurities to said filtering section and to said cartridge in said filtering section;

(c) removing said metallic hydroxide salt with said cartridge in said filtering section, and forming a cleaned aqueous medium;

(d) removing said cleaned aqueous medium from said cartridge in said filtering section;

(e) drying said cartridge in said filtering section after said cartridge in said filtering section has become blocked by said metallic hydroxide salt and said cartridge in said filtering section is moved to said drying section, thereby forming a powder on said dried cartridge and simultaneously placing said other cartridge from said drying section into said filtering section whereby said aqueous medium with metallic hydroxide salts is continuously in contact with one said filter cartridge; and (f) removing said powder from said dried cartridge in said drying section.

8. The method according to claim 7 wherein drying said cartridge comprises blowing air across said cartridge.

9. The method according to claim 8 further comprising the step of heating said air prior to blowing said air across said cartridge.

10. The method according to claim 7 wherein removing said powder comprises blowing air through said cartridge.

11. The method according to claim 7 wherein removing said powder comprise back flushing air through said cartridge.

* * * * *